United States Patent [19]

Dalman

[11] 4,030,095

[45] June 14, 1977

[54] PULSED ALARM SYSTEM

[75] Inventor: Edward Dalman, Arlington Heights, Ill.

[73] Assignee: Honeywell Inc., Minneapolis, Minn.

[22] Filed: Jan. 19, 1976

[21] Appl. No.: 650,490

[52] U.S. Cl. ..... 340/413; 340/255; 340/276

[51] Int. Cl.[2] ..... G08B 19/00

[58] Field of Search ..... 340/210, 213 R, 248 R, 340/248 A, 248 B, 255, 276, 409, 412, 413, 420, 181; 317/31, 33 R

[56] References Cited

UNITED STATES PATENTS

| | | | |
|---|---|---|---|
| 2,782,404 | 2/1957 | Bergman | 340/253 |
| 2,814,795 | 11/1957 | Spooner | 340/213 |
| 3,588,890 | 6/1971 | Cox | 340/409 |
| 3,626,398 | 12/1971 | Owens, Jr. | 340/413 X |
| 3,631,268 | 12/1971 | Matthews | 307/273 |
| 3,701,113 | 10/1972 | Chace et al. | 340/172.5 |
| 3,789,242 | 1/1974 | Cantor | 307/235 R |
| 3,812,487 | 5/1974 | Burton | 340/413 X |
| 3,848,241 | 11/1974 | LeNay et al. | 340/214 |
| 3,947,811 | 3/1976 | Hodgson | 340/413 X |

*Primary Examiner*—Alvin H. Waring
*Attorney, Agent, or Firm*—Trevor B. Joike

[57] ABSTRACT

A pulse supply alarm system supplies a set of energizing pulses spaced sequentially in time to a plurality of alarm sensing circuits and supplies a set of synchronizing pulses, synchronized to the set of energizing pulses, to a plurality of indicating circuits each one of which corresponds to an alarm sensing circuit such that each indicating circuit will generate an alarm indication only upon an alarm condition sensed during the time which its associated alarm sensing circuit receives its energizing pulse.

10 Claims, 8 Drawing Figures

PULSED ALARM SYSTEM

BACKGROUND OF THE INVENTION

The present invention relates to condition indicating systems and more particularly to alarm indicating systems which may be of the fire and/or security type.

Prior art condition indicating circuits are energized typically in one of two ways. The first way is to supply the sensing apparatus with continuous power. However, as can be readily seen, the application of continuous power to an alarm apparatus results in the undue use of power as compared to circuits which energize the sensing apparatus by the use of pulses of energy.

The prior art has recognized that, if the sensing apparatus receives energy pulses rather than a continuous energy supply, power will be saved. Therefore, the prior art devised this second way of energizing the alarm apparatus; i.e. supplying pulses of energy to condition indicating circuits. However, these prior art systems require the use of an intergrating capacitor which is maintained in either a charged condition or a discharged condition as long as a receiver receives pulses of energy. If the pulses supplied to the receiver cease or if the receiver receives continuous energization, the capacitor discharges or charges to provide an alarm or indication. This prior art apparatus requires the use of an integrator and is unsuitable if more than one sensor is to be supplied from a single power supply.

SUMMARY OF THE INVENTION

The condition sensing apparatus or an alarm sensing apparatus of the present invention is supplied with pulses from a pulse source. If the sensing apparatus comprises more than one alarm sensing apparatus, the pulses are supplied to the sensors in a sequential timed sequence. Condition indicating apparatus are provided each one of which is synchronized to its associated condition sensing apparatus by the receipt of pulses synchronized to the pulses supplied to the condition sensing apparatus. Since the condition indicating apparatus may respond to a below normal voltage output from the condition sensing apparatus, and since the output from the condition sensing apparatus is normally low during the time when it is not pulsed, it is necessary to synchronize the operation of the condition sensing apparatus to prevent an indication during the time when the pulse to the sensing apparatus has fallen to zero.

BRIEF DESCRIPTION OF THE DRAWINGS

These and other advantages and features will become apparent from a detailed consideration of the drawings in which.

DETAILED DESCRIPTION OF THE DRAWINGS

Figure 1:
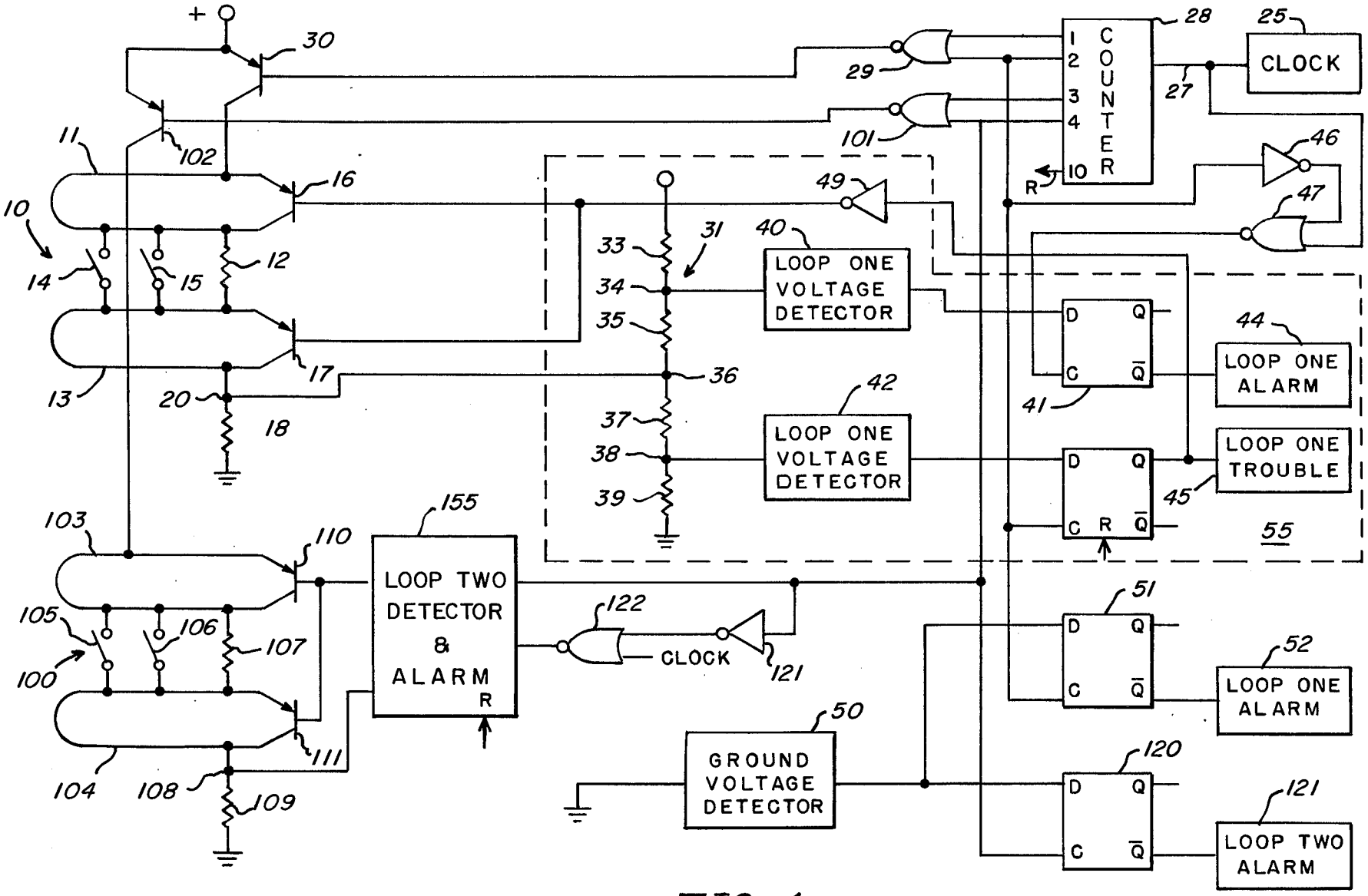
FIG. 1 is the circuit schematic of the invention.

In FIG. 1, sensor means 10 is provided to sense a condition which may, for example, be a fire and/or security condition. Sensor means 10 comprises first loop 11 connected by resistor 12 to second loop 13. Fire and/or security switches 14 and 15 are provided in parallel with resistor 12 to sense a specified condition.

Loops 11 and 13 comprise a four wire sensor the integrity of which may be checked by an appropriate indicating circuit. If the integrity of the four wire sensor is compromised, transistors 16 and 17 may be energized to maintain the ability of the sensor to sense alarms until the integrity is restored, which operation will be described hereinbelow.

The output from sensor 10 is taken across resistor 18 which is connected between loop 13 and circuit ground. The resistance of loops 11 and 13 may be in the range of 0.1–50 ohms per loop such that a voltage divider comprising the resistance of loop 11, resistor 12, the resistance of loop 13 and resistor 18 is formed and the output of the loop is taken at terminal 20.

Figure 3:
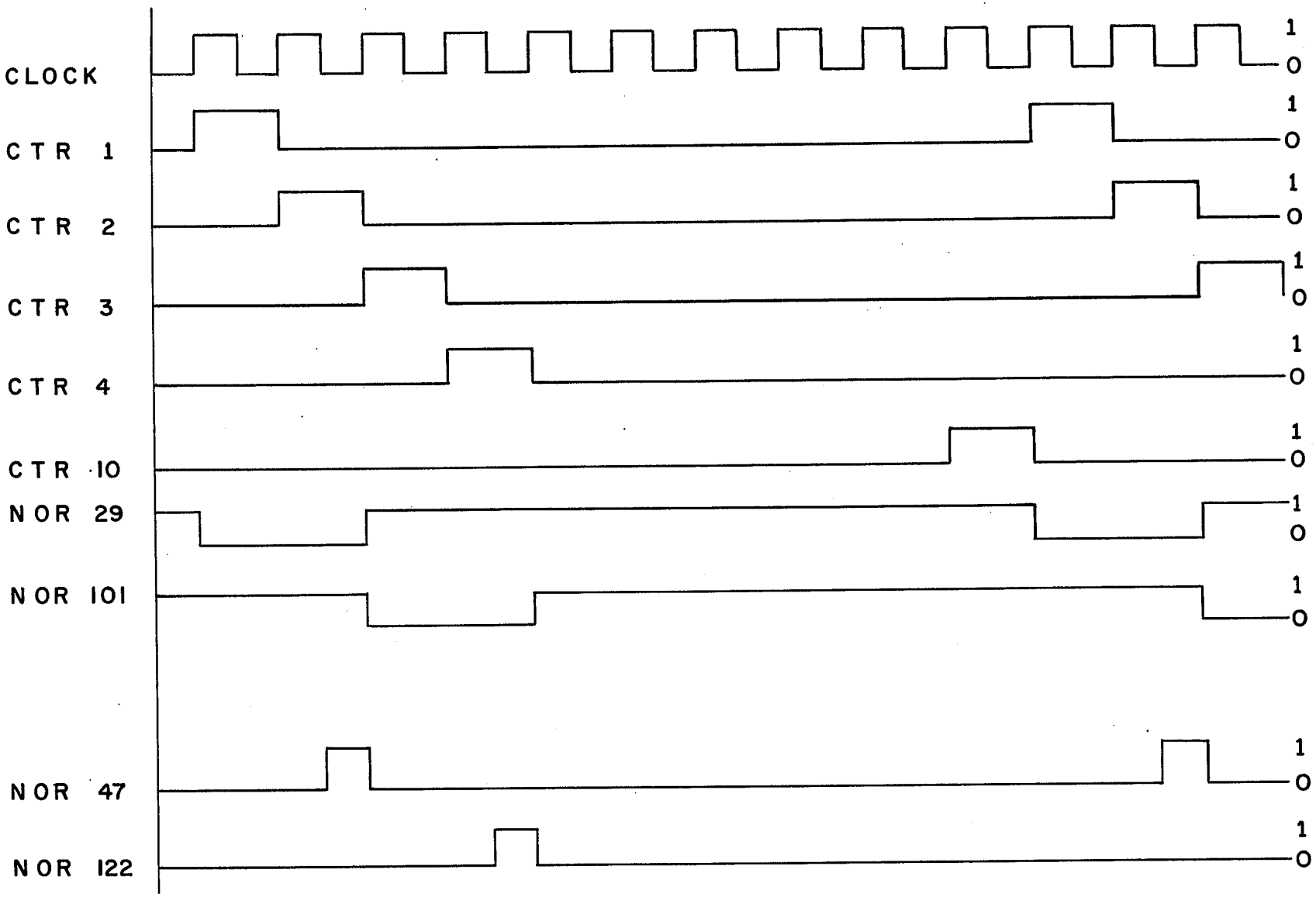

Sensor 10 is supplied with energizing pulses from a pulse source means comprising clock 25 which is connected by line 27 to counter 28. The output pulses from the clock are shown in FIG. 3 and the outputs from the ten output terminal counter are also shown in FIG. 3. Output terminals 1 and 2 of counter 28 are connected to the inputs of NOR gate 29 the output of which is connected to the base terminal of transistor 30 the emitter of which is connected to a positive power supply and the collector of which is connected to loop 11. As can be seen from FIG. 3, because terminals 1 and 2 of the counter 28 are paired by NOR gate 29, the output from NOR gate 29 lasts for two complete cycles of the pulses produced by clock 25.

Terminal 20 is connected to voltage divider 31, which is connected between a positive source and circuit ground, of condition indicating means 55. The voltage divider comprises resistor 33 having one end connected to the positive source and a second end connected to terminal 34. A second resistor, 35, has one end connected to terminal 34 and a second end connected to terminal 36 which is directly connected to terminal 20. A third resistor, 37, is connected between terminal 36 and terminal 38 and a fourth resistor, 39, is connected between terminal 38 and circuit ground. A voltage detector 40 has an input connected to terminal 34 and an output connected to the D terminal of D flip-flop 41. A second voltage detector 42 has an input connected to terminal 38 and an output connected to the D terminal of D flip-flop 43. The $\overline{Q}$ terminal of D flip-flop 41 is connected to an alarm indicator 44 and the Q terminal of flip-flop 43 is connected to a trouble indicator 45. The clock terminal of D flip-flop 41 is connected to the output of NOR gate 47 having a first input from clock 25 and a second input from output terminal 2 of counter 28 through inverter 46 and the clock terminal of D flip-flop 43 is connected directly to the second output of counter 28.

Figure 2A:
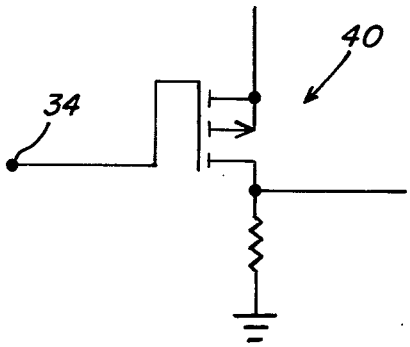
FIGS. 2*a*–2*f* are more detail representations of the voltage detectors, and their responses, shown in FIG. 1; and, FIG. 3 shows the time sequence of the pulses supplied to the circuit of FIG. 1.
Figure 2D:
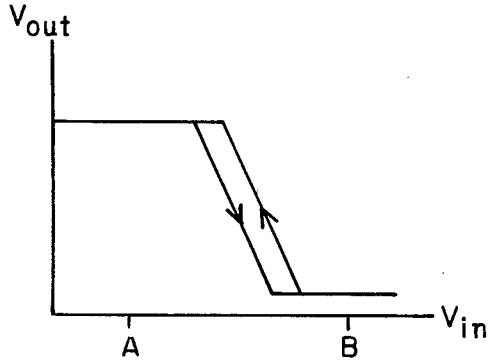

The voltage detector 40 is shown in more detail in FIG. 2*a* and comprises a CMOS transistor circuit having the response shown in FIG. 2*d*. The point A shown in FIG. 2*d* represents the normal input voltage applied to the detector 40 such that the output from the detector is normally high. Thus, under normal conditions, when the D flip-flop 41 receives a clock pulse, the Q terminal is normally a 1 and the $\overline{Q}$ terminal is normally a zero to maintain the alarm 44 de-energized. When the input voltage applied to detector 40 is raised to point B in FIG. 2*d*, however, the output from the detector 40 falls to an effective zero which results inthe Q and $\overline{Q}$ terminals switching states upon the next clock pulse received from NOR gate 47 to energize the alarm 44.

Figure 2B:
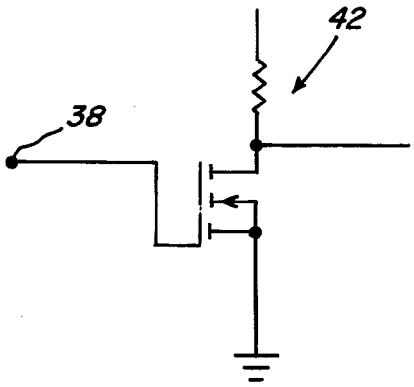
Figure 2E:
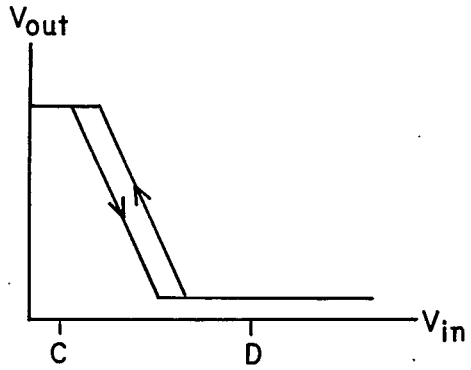

Likewise, the detector 42 shown in FIG. 1 is shown in more detail in FIG. 2*b* and comprises a CMOS transistor circuit having the response curve shown in FIG. 2*e*. Under normal conditions, the input received by the CMOS device is at point D in FIG. 2*e* such that the output from the device is a zero and thus the trouble indicator 45 is normally de-energized.

Under normal, non-alarm conditions and during the time that sensor 10 is not receiving an energizing pulse, the voltage which is present at terminals 20, 34 and 38 will not affect flip-flops 41 and 43 and alarms 44 and 45 since flip-flops 41 and 43 do not receive clock pulses. Alarms are, thus, sensed only during the time when sensor 10 receives an energizing pulse. When the output from NOR 29 goes low, as shown in FIG. 3, transistor 30 is energized to supply an energizing pulse to sensor 10. Under normal conditions, the voltage at terminal 20, and hence the voltage at terminal 36, is of such a value as to maintain the voltage of terminal 34 at point A on the curve of FIG. 2*d* and the voltage of terminal 38 at point D on the curve of FIG. 2*e*. If an alarm condition is sensed such that either the switch 14 or 15 is closed, the resistor 12 is shorted such that the voltage at point 20 is increased. The increase of the voltage at terminal 20 increases the voltage at both terminals 34 and 38. An increase in voltage at terminal 34 switches the output of detector 40 to a low state. During the time when sensor 10 receives its energizing pulse, the clock terminal of flip-flop 41 receives a pulse from NOR 47 which causes D flip-flop 41 to switch to energize the alarm 44. At the same time, the voltage at terminal 38 increases which has no effect on the output of detector 42 and the trouble indicator 45 remains de-energized when flip-flop 43 receives its clock pulse.

If one of the loops becomes short circuited, the above described operation will not be effected.

If one of the loops becomes open circuited, current flow through the loop terminates and the voltage at terminal 20 drops. The voltage at terminal 34 likewise drops which, as can be seen from the curve of FIG. 2*d*, has no effect on the detector 40. The voltage at terminal 38 drops from the normal D point on the curve of FIG. 2*e* to the C point. The output from detector 42 then assumes a high state such that the D flip-flop 43 switches upon the receipt of the next clock pulse. The Q terminal of flip-flop 43 thus becomes a high value which energizes the trouble indicator 45 and energizes the transistors 16 and 17 through inverter 49. Thus, the open circuit condition which may exist on either loop 11 or loop 13 is short circuited by the transistors 16 and 17 to restore the integrity of sensor 10. When output 10 of counter 28 produces its pulse, the flip-flop 43 will be reset so that this flip-flop will again respond to an open condition in sensor 10. Thus, trouble indicator 45 will flash. After flip-flop 43 has been reset, the next pulse to sensor 10 from transistor 30 will result in no current flow through loops 11 and 13 since the sensor is open circuited which is again sensed by detector 42 and flip-flop 43 to re-energize transistors 16 and 17. Once the transistors 16 and 17 have been re-energized, detector 40 and flip-flop 41 can respond to an alarm condition. If switch 14 or switch 15 had closed after before transistors 16 and 17 are re-energized, the voltage at terminal 34 will be higher than normal during the pulse from transistor 30. Thus, on the next clock pulse to flip-flop 41, indicator 44 will be energized. The clock pulse to flip-flop 41 is delayed, by inverter 46 and NOR 47, from the clock pulse to flip-flop 43 to insure that the alarm sampling operation is begun after integrity has been restored to sensor 10 by energization of transistors 16 and 17.

Figure 2C:
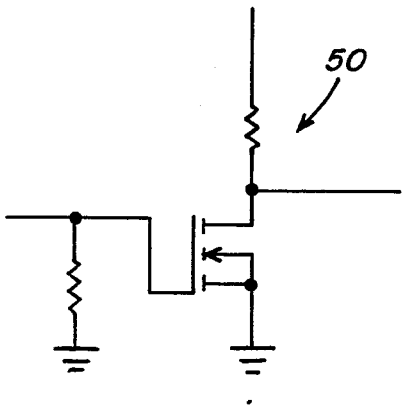
Figure 2F:
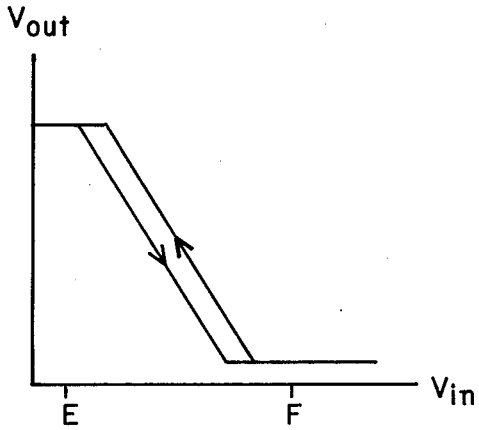

In fire and/or security systems where integrity is checked and maintained, it is necessary to sense when the sensing loops 11 and/13 are earth grounded. To this end, ground voltage detector 50 has an input connected to earth ground and an output connected to the D terminal of flip-flop 51 the $\overline{Q}$ terminal of which is connected to a loop one alarm indicator 52. If the loop 11 or 13 becomes connected to earth ground, the current resulting from the pulse issuing from transistor 30 flows through sensor 10, the earth ground into the input of detector 50 which is shown in more detail as a CMOS device in FIG. 2*c* the response curve of which is shown in FIG. 2*f*. Under normal conditions the input to the detector 50 is normally low such that its output is normally high. Thus, upon receipt of clock pulses to the clock terminal of D flip-flop 51, the Q terminals is maintained at a one level and the $\overline{Q}$ terminal is maintained at a zero level and alarm 52 is de-energized. However, when a ground condition exits on sensing loop 10, the input to the detector 50 becomes high which changes its output to a low value which energizes the alarm indicator 52 upon receipt by the D flip-flop 51 of the next clock pulse. At the same time, when a ground condition exists on the loop, the terminal 20 voltage behaves normally due to the fact that the system ground is floating from the earth ground.

This arrangement is suitable for supplying pulses to as many as four sensors, such as the sensor 10. Thus, the outputs 3 and 4 from the counter 28 are connected to the inputs of NOR gate 101 the output of which is connected to a transistor 102 having its emitter connected to the positive source and the collector of which is connected to a second sensor 100 comprising first loop 103 and second loop 104. Connected between the loops are sensing switches 105 and 106 connected across resistor 107 which comprises loop 103 to loop 104. The output from sensor 100 is connected to terminal 108 which in turn is connected to a resistor 109 the other side of which is connected to circuit ground. The loop two detector and alarm or condition indicating apparatus 155 is connected to terminal 108 and has an output connected to transistors 110 and 111. The condition indicating means 155 is similar to the condition indicating means 55. The sensing means 100 receives an energization pulse corresponding to the output from NOR gate 101 shown in FIG. 3. The output 4 of counter 28 is connected to the clock terminal of a trouble D flip-flop and the output from NOR 122 and inverter 121 is connected to the clock terminal of an alarm D flip-flop within condition indicating means 155 which clock pulses are shown in FIG. 3. As shown in FIG. 3, the pulses received by sensor 10 and sensor 100 are staggered to again conserve on the power drain of the alarm apparatus. A second D flip-flop 120 has its D terminal connected to the output of ground voltage detector 50 which has its $\overline{Q}$ output terminal connected to a loop two ground alarm 121.

Two additional sensing means and corresponding condition indicating means may likewise be provided. In fact, any number of loops may be provided if an appropriate counter 28 is chosen.

The embodiments of the invention in which an exclusive property or right is claimed are defined as follows.

1. A pulse indicating system comprising:

pulse source means for supplying energizing pulses and synchronizing pulses;

sensor means connected to be energized by said energizing pulses for providing a sensed output dependent upon a sensed condition;

voltage divider means comprising an impedance circuit having an input connected to receive said sensed output and first and second outputs, a high voltage detection circuit having an input connected to said first output and having a first detection output, and a low voltage detection circuit havng an input connected to said second output of said impedance circuit and having a second detection output;

a first switch having a first input connected to said first detection output, a second input connected to receive said synchronizing pulses, and a switch output;

a second switch having a first input connected to said second detection output, a second input connected to receive said synchronizing pulses, and a second switch output; and, indicating means connected to said first and second switch outputs.

2. A pulse indicating system comprising:

pulse source means comprising means for supplying a first set of energizing pulses, means for supplying a second set of energizing pulses, means for supplying a first set of synchronizing pulses synchronized to said first set of energizing pulses, and means for supplying a second set of synchronizing pulses synchronized to set second set of energizing pulses wherein said first and second sets of pulses are spaced sequentially in time one from the other;

sensor means comprising a first sensor connected to be energized by said first set of energizing pulses for providing a first sensed output dependent upon a first sensed condition.

a second sensor connected to be energized by said second set of energizing pulses for providing a second sensed output dependent upon a second sensed condition; and, condition indicating means comprising first indicating means connected to receive said first sensed output for providing an indication of said first sensed condition and also connected to receive said first set of synchronizing pulses for synchronizing said first indicating means to said first sensor, and second indicating means connected to receive said second sensed output for providing an indication of said second sensed condition and also connected to receive said second set of synchronizing pulses for synchronizing said second indicating means to said second sensor.

3. The system of claim 2 wherein said first indicating means comprises first indicator control means having a first means input connected to receive said first sensed output and a second input connected to receive said first set of synchronizing pulses and having an output, second indicator control means having a first input connected to receive said first sensed output and a second input connected to receive said first set of synchronizing pulses and having an output, and indicator means connected to said outputs of said first and second indicator control means of said first indicating means; and, said second indicating means comprises first indicator control means having a first input connected to receive said second sensed output and a second input connected to receive said second set of synchronizing pulses and having an output, second indicator control means having a first input connected to receive said second sensed output and a second input connected to receive said second set of synchronizing pulses and having an output, and indicator control means connected to said first and second indicator control means of said second indicating means.

4. The system of claim 3 wherein said means for supplying a first set of synchronizing pulses comprises a first source for supplying first synchronizing pulses to said second input of said second indicator control means of said first indicating means, and a second source for supplying second synchronizing pulses, delayed from said first synchronizing pulses, to said second input of said first indicator control means of said first indicating means, and said means for supplying a second set of synchronizing pulses comprising a third source for supplying third synchronizing pulses to said second input of said second indicator control means and said second indicating means, and a fourth source for supplying fourth synchronizing pulses, delayed from said third synchronizing pulses, to sayd second input of said first indicator control means of said second indicating means.

5. The system of claim 1 wherein said system further comprises a ground voltage detector having an input connected to earth ground and an output and a switch having a first input connected to said output of said ground voltage detector, a second input connected to receive said synchronizing pulses and an output connected to an indicator.

6. The system of claim 2 wherein said first and second indicating means each comprises indicating control means having first input means connected to receive its corresponding sensed output, second input means connected to receive its corresponding set of synchronizing pulses and an output means for providing a corresponding indication.

7. The system of claim 6 wherein said first input means of said indicating control means corresponding to said first and second indicating means each comprises voltage divider means having an input connected to receive said corresponding sensed output and an output means connected to said corresponding second input means.

8. The system of claim 7 wherein said voltage divider of said first input means corresponding to said first indicating means comprises a first impedance circuit having an input connected to receive said first sensed output and a first impedance circuit output means, a first high voltage detection circuit having an input connected to said first impedance circuit output means and a first high voltage output, and a first low voltage detection circuit having an input connected to said first impedance circuit output means and a first low voltage output, said second input means of said first indicating means comprises a first switch having a first input connected to said first high voltage output, a second input connected to receive said first set of synchronizing pulses and an output connected to said output means of said first indicating means, and a second switch having a first input connected to said first low voltage output, a second input connected to receive said first set of synchronizing pulses and an output connected to said output means of said first indicating means, said voltage divider of said first input means corresponding to said second indicating means comprises a second impedance circuit having an input connected to receive said second sensed output and a second impedance circuit output means, a second high voltage detection circuit having an input connected to said second impedance circuit output means and a second high voltage output, and a second low voltage detection circuit having an input connected to said second impedance circuit output means and a second low voltage output, said second input means of said second indicating means comprises a first switch having a first input connected to said second high voltage output, a second input connected to receive said second set of synchronizing pulses and an output connected to said output means of said second indicating means, and a second switch having a first input connected to said second low voltage output, a second input connected to receive said second set of synchronizing pulses and an output connected to said output means of said second indicating means.

9. The system of claim 8 wherein said means for supplying a first set of synchronizing pulses comprises a first source for supplying first synchronizing pulses to said second switch of said second input means of said first indicating means, and a second source for supplying second synchronizing pulses, delayed from said first synchronizing pulses, to said first switch of said second input means of said first indicating means, and said means for supplying a second set of synchronizing pulses comprises a third source for supplying third synchronizing pulses to said second switch of said second input means of said second indicating means, and a fourth source for supplying fourth synchronizing pulses, delayed from said third synchronizing pulses, to said first switch of said second input means of said second indicating means.

10. The system of claim 9 wherein said condition indicating means further comprises first ground indicating means comprising a first ground voltage detector having a first input connected to earth ground, a second input connected to receive said first synchronizing pulses and a first sensor ground indicator, and a second ground indicating means comprising a second ground voltage detector having a first input connected to earth ground, a second input connected to said third synchronizing and a second sensor ground indicator.

* * * * *